United States Patent [19]

Cismoski

[11] Patent Number: 4,998,546

[45] Date of Patent: Mar. 12, 1991

[54] METHOD AND APPARATUS FOR GRIP ENHANCING

[76] Inventor: Frank J. Cismoski, P.O. Box 123, Oak Lawn, Ill. 60454

[21] Appl. No.: 365,776

[22] Filed: Jun. 14, 1989

[51] Int. Cl.[5] ..... B08B 3/08

[52] U.S. Cl. ..... 134/40; 134/25.1; 134/42

[58] Field of Search ..... 134/25.1, 25.4, 40, 134/39, 41, 10, 38; 15/21 R, 21 D, 21 E, 76, 104.4; 252/170, 171; 8/142

[56] References Cited

U.S. PATENT DOCUMENTS 4,530,776 7/1985 Hisamoto et al. ..... 134/40

4,676,839 7/1987 Osborn ..... 134/25.4

OTHER PUBLICATIONS

"The Condensed Chemical Dictionary", 8th Edition, p. 886, New York, 1971.

*Primary Examiner*—Asok Pal

*Attorney, Agent, or Firm*—Hill, Van Santen, Steadman & Simpson

[57] ABSTRACT

A method for enhancing the grip characteristics of a handle or hand grip includes applying a grip enhancing compound containing trichloroethane to the handle. Although the compound may be applied in many different ways, a coin operated apparatus is provided which selectively allows a hand grip to pass between a pair of opposed rollers, through a circular brush and into a reservoir of the grip enhancing liquid for treatment. The opposed rollers are movable to a locked position to inhibit passage of the hand grip into the liquid when no coin or credit token has been deposited.

10 Claims, 1 Drawing Sheet

FIG. 1
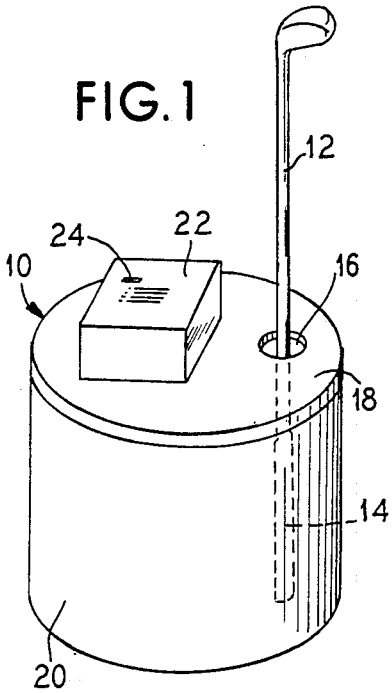
FIG. 2
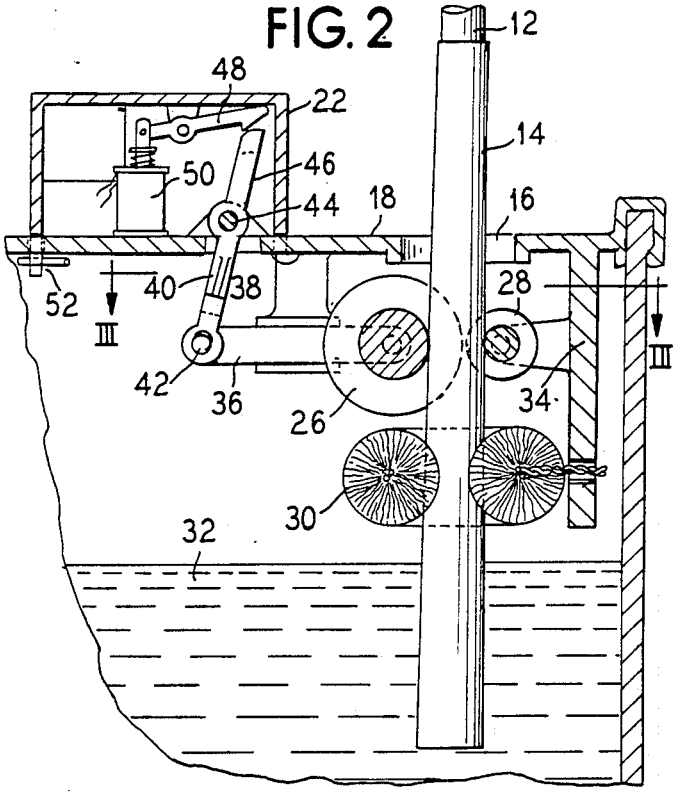
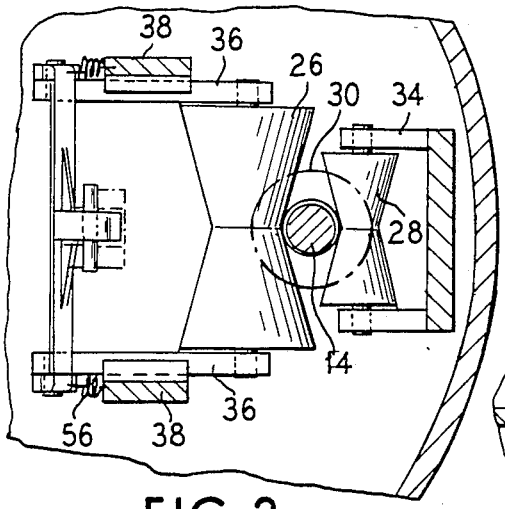
FIG. 3
FIG. 4
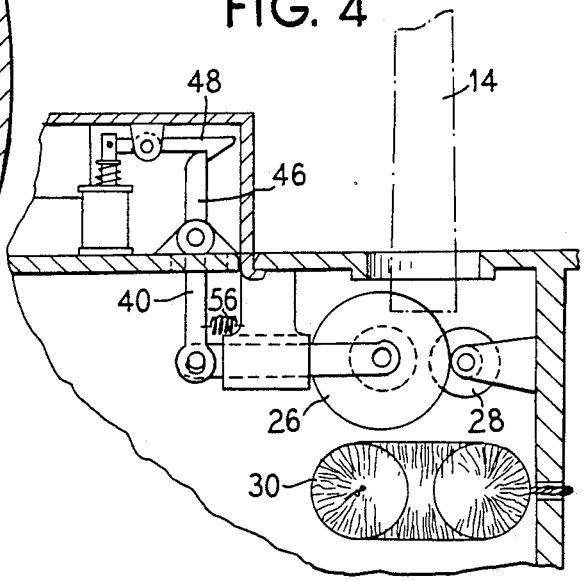

METHOD AND APPARATUS FOR GRIP ENHANCING

BACKGROUND OF THE INVENTION

1. Field of the Invention

The present invention relates generally to a method for enhancing the grip characteristics of a handle and to an apparatus for practicing the method.

2. Description of the Related Art

Grips and handles, particularly rubberized grips, often lose their gripping characteristics and become slippery and hard due to aging and use. Grips and handles, such as on sporting equipment and in particular on golf clubs, are less effective as they become hardened, causing slipping of the club and an undesirable increase in teh grasping force of the golfer. To remedy this problem, golf club grips and other grips and handles are often replaced at great expense.

Cleaners for handles and grips, such as for golf clubs, are known. For example, U.S. Pat. Nos. 4,676,839 and 4,750,230 disclose an electrically powered automatic golf club grip cleaning unit with a rotating carousel-like lid for accepting a plurality of inverted golf club shafts and passing them through a wash and rinse zone while they make abrasive contact with spinning brushes.

In U.S. Pat. No. 4,554,696 is disclosed an electrically powered brush assembly for wet scrubbing and cleaning of the hand grip of a golf club. the elongated housing includes at least one elongated brush as well as an electric drive motor connected to the brush for scrubbing the golf club grip.

Grip enhancing compounds, also known as belt dressing compounds, for rubber drive belts, are known.

SUMMARY OF THE INVENTION

An object of the present invention is to enhance the grip characteristics of handles and grips.

Another object of the invention is to renew and soften grips on sporting equipment and the like.

A further object is to provide an inexpensive and easy method for enhancing the grip characteristics of a handle.

Yet another object of the invention is to provide an apparatus for applying a grip enhancing compound to a handle, and in particular, a coin operated apparatus.

These and other objects of the invention are achieved in a method for enhancing the grip characteristics of a handle or grip which includes the step of applying a grip enhancing material or compound to the handle, where the grip enhancing material contains trichloroethane. A further step of the method may be wiping the excess grip enhancing compound from the handle after the step of applying. The step of applying the grip enhancing compound may be accomplishd either by dipping the handle into a reservoir of the grip enhancing compound or by an aerosol or spray application of the grip enhancing compound to the handle.

The handle to which the grip enhancing compound is applied may be any of a number of different types of handles. The present method finds particular utility in enhancing the gripping characteristics of handles for sproting equipment including, but not limited to, golf clubs, badminton rackets, tennis rackets, squash rackets, etc. It may also be used on hand tools, such as hammers with rubber grips.

The grip enhancing compound generally contains both trichloroethane and alcohol, with trichloroethane being in the larger amount.

In a preferred embodiment, the grip enhancing compound is a liquid comprising trichloroethane in a range of approximately 55 through 70 percent, denatured alcohol in a range of approximately 5 through 10 percent, and the balance of the compound being inert ingredients. Such grip enhancing compounds soaks into the rubber or other handle material to soften the material so that the grip characteristics are improved. The compound works best on rubber and rubberized handles, but also works on leather and other materials as well.

The present invention also provides an apparatus for application of the grip enhancing compound to a handle. In one embodiment, the apparatus may simply be a reservir or a bottle of the grip enhancing compound into which the handle is dipped or from which an applicator distributes the grip enhancing compound onto the handle. The applicator can be a wick tpe applicator, a sponge applicator or even a rag or other fibrous or non-fibrous material saturated with the grip enhancing compound for applying it to the handle. A convenient applicator for the grip enhancing compound is an aerosol or spray container, such as a pump spray, by which the grip enhancing compound is sprayed onto the handle. For purposes of the present application the term "aerosol" includes pump-type sprayers as well as propellant-type sprayers. It is also contemplated that the grip enhancing material or compound may be in solid form, such as a stick shape, for ease of application.

The present invention also provides a coin operated applicator for use in clubhouses, pro shops, locker rooms and the like at tennis clubs, country clubs, driving ranges, etc. In one embodiment, the coin operated applicator includes a bucket-like reservoir having a lid over the top thereof through which extends an opening for accepting a handle. A coin operated mechanism controls access through the opening so that the handle may be inserted into the reservoir of grip enhancing liquid only after a coin or other payment means is accepted by the mechamism. In a preferred embodiment, a pair of opposed rollers close the opening to access by a handle and move to a handle accepting position after payment is received.

BRIEF DESCRIPTION OF THE DRAWINGS

FIG. 1 is a perspective view of a coin operated apparatus for applying a grip enhancing compound to a grip of a golf club in accordance with the present invention;

FIG. 2 is a vertical cross-sectional view of the apparatus of FIG. 1 generally along the direction of the golf club shaft;

FIG. 3 is a horizontal cross section along lines III—III of FIG. 2 showing the golf club grip extending between the rollers; and FIG. 4 is a cross section generally in the same direction as FIG. 2 showing the coin operated mechanism inhibiting entry of the golf club grip into the liquid reservoir.

DETAILED DESCRIPTION OF THE PREFERRED EMBODIMENTS

In FIG. 1 is shown a coin operated apparatus 10 for applying a grip enhancing compound to a handle. In the illustration, a golf club 12 having a grip 14 of a rubberized material is inserted through an opening 16 in a lid 18 of the apparatus 10. The lid 18 is fastened onto a bucket-like liquid reservoir 20 within which the grip enhancing compound is held. Mounted atop the lid 18 is a coin operated control box 22 having a coin slot 24 into which a coin or other credit token is placed for activating the coin operated mechanism.

In FIG. 2 can be seen the grip 14 of the golf club 12 extending, first, through the opening 16 in the lid 18, second, between a pair of opposed rollers 26 and 28, through a bursh 30, and finally, into a grip enhancing liquid compound 32. The rollers 26 and 28 guide the grip 14 through the brush 30 and into the liquid 32 and also operate to selectively limit access to the grip enhancing liquid by the handle 14.

The roller 28 is fixed to a support 34 extending downwardly from an underside of the lid 16. The support 34 also holds the brush 30. The roller 26 is selectively movable relative to the roller 28 and is mounted on slides 36 supported in bushing members 38 extending downwardly from the underside of the lid 16 so that the roller 26 moves horizontally. A lever 40 is connected at an opposite end of the slides 36 by a pivot 42. The lever 40 is mounted at a stationary pivot 44 within the housing 22 on the lid 18.

Within the housing 22 is a means for selectively locking the lever 40 in a first position which blocks entry of a grip through the rollers 26 and 28, and which also is selectively operable to a position which permits the roller 26 to slide to a position accepting the grip 14 between the rollers 26 and 28. For example, the lever 40 can include an extension 46 which is selectively engaged by a catch 48 operated through a spring biased solenoid 50. After a coin is inserted through the coin slot 24, the solenoid 50 operates to release the catch 48 and permit pivoting of the lever 40. As will be appreciated by those of skill in the art, a great many different coin operated mechanisms may be used in place of the illustrated example to provide selective access to the liquid containing reservoir. In place of the electromechanical solenoid, a purely mechanical means may be preferred.

To assure that unauthorized access to the liquid reservoir is prohibited or at least inhibited, the coin operated mechanism housing 22 is locked onto the lid 18 by a fastening means 52. Also, the lid 18 is securely fastened on the side walls of the container 20 to prevent ready removal except by authorized personnel. The lid 18 may be locked onto the container 20, by lock means which are well known in the art.

In FIG. 3 is shown the grip 14 extending between the rollers 26 and 28. Each of the rollers 26 and 28 is of a cylindrical configuration having a reduced diameter portion generally at the center thereof to aid in guiding the grip 14 through the center of the brush 30. The rollers 26 and 28 are tapered from the center to larger diameter ends so that each roller has the configuration of a pair of cones lying on the same axis and joined at their frustrums. The rollers 26 and 28 are mounted to freely rotate about the their axes and, as set forth above, the roller 28 is stationarily mounted on the support 34 while the roller 26 is mounted on the slides 36 which move horizontally through bushings 38.

The brush 30, in a preferred embodiment, is a circular brush or bung having a center opening through which the grip 14 is passed. The brush 30 serves to wipe excess compound from the handle when it is withdrawn from the reservoir.

In FIG. 4, the coin operated mechanism is locked to prevent passage of the grip 14 between the rollers 26 and 28. The extension 46 of the lever 40 is engaged by the latch 48 and is thereby prevented from pivoting to an access permitting position. In the position illustrated in FIG. 4, the spacing between the rollers 26 and 28 is too small to permit the grip 14 from passing therebetween so that access to the container by a grip is inhibited. To bias the movable roller 26 to the closed position, a spring or other biasing means 56 is provided.

The illustrated grip enhancing apparatus is operated by depositing a coin or other credit token through the slot 24 so that the catch 48 is released, thereby permitting a grip 14 to pass between the rollers 26 and 28. The particular configuration of the rollers with a reduced diameter midsection guides the grip 14 through the central opening of the circular brush 30 and into the liquid 32. The golf club is moved up and down within the container so that the entire grip section 14 is wetted by the grip enhancing liquid 32. As the golf club 12 is withdrawn from the container, the brush 30 wipes the excess liquid from the grip. After the grip is withdrawn, the movable roller 26 moves to the access inhibiting position and the catch 48 latches the lever 40 so that subsequent access is inhibited. For treatment of another golf club grip, a further coin or credit token is deposited through the slot 24 to begin the sequence again. It is also contemplated that the coin operated mechanism may be timed to permit the treatment of several clubs within a predetermined interval.

Not only can the grip enhancing liquid be applied to a hand grip or other handle by the illustrated apparatus, but it is also possible to apply the grip enhancing compound by many other means including simply placing the grip into a reservoir of the liquid and then wiping the exceess liquid from the hand grip. A spray or aerosol applicator can be used, as well as a wick or saturated applicator.

The grip enhancing compound 32 contains an agent for softening hardened rubber or rubberized grip material. For example, the grip enhancing compound may contain trichloroethane in sufficient quantity to renew the grip characteristics of a hand grip. Although smaller concentrations or trichloroethane may be effective, it is preferred that the grip enhancing compound contain at least 50 percent by volume trichloroethane. Alcohol, such as denatured alcohol, may also be included in the compound. In one example, the grip enhancing compound contains trichloroethane in a range of approximately 55 to 70 percent by volume, denatured alcohol in a range of approximately 5 to 10 percent by volume, and inert ingredients as the balance of the compound.

It has been found that rubberized grips on golf clubs, sporting rackets and many other types of devices, even including hammers and the like, can be softened and renewed after they have become hard and slippery by a single treatment of the present grip enhancing compound. Should the hand grip again become hardened and slippery, subsequent treatments may be performed.

Thus, there is disclosed a method and apparatus for enhancing the grip characteristics of a hand grip or handle which is quick and easy as well as considerably less expensive than replacing the grips.

Although other modifications and changes may be suggested by those skilled in the art, it is the intention of the inventor to embody within the patent warranted hereon all changes and modifications as reasonably and properly come within the scope of his contribution to the art.

I claim:

1. A method of enhancing grip characteristics of a rubber handle or grip, comprising:

restoring pliability to a rubber handle or grip by applying a grip enhancing material to said handle or grip, said grip enhancing material containing trichloroethane.

2. A method as claimed in claim 1, wherein said handle or grip is a handle or grip of a golf club.

3. A method as claimed in claim 1, further comprising the step of:

wiping excess grip enhancing material from said handle or grip after said grip enhancing material is applied to said handle or grip.

4. A method as claimed in claim 1, wherein said step of restoring is accomplished by dipping said handle or grip into a reservoir of said grip enhancing material in a liquid state.

5. A method as claimed in claim 1, wherein said step of restoring is accomplished by aerosol application of said grip enhancing material to said handle or grip.

6. A method as claimed in claim 1, wherein said grip enhancing material comprises at least 50 percent trichloroethane.

7. A method as claimed in claim 1, wherein said grip enhancing material comprises:

trichloroethane in a range of 55–70 percent, denatured alcohol in a range of 5–10 percent, and a balance of inert ingredients.

8. A method for refurbishing rubber handles and grips, comprising the step of:

applying a grip enhancing compound to an elastomeric handle or grip, said grip enhancing compound including trichloroethane for improving pliability of said elastomeric handle or grip.

9. A method as claimed in claim 8, wherein said grip enhancing compound is a liquid.

10. A method as claimed in claim 9, wherein said liquid is applied in aerosol form.

* * * * *